US011203796B2

(12) United States Patent
Kim et al.

(10) Patent No.: US 11,203,796 B2
(45) Date of Patent: Dec. 21, 2021

(54) ULTRA HIGH STRENGTH HOT-ROLLED STEEL SHEET HAVING EXCELLENT DUCTILITY AND METHOD FOR MANUFACTURING SAME

(71) Applicant: POSCO, Pohang-si (KR)

(72) Inventors: Sung-Il Kim, Gwangyang-si (KR); Seok-Jong Seo, Gwangyang-si (KR)

(73) Assignee: POSCO, Pohang-si (KR)

( * ) Notice: Subject to any disclaimer, the term of this patent is extended or adjusted under 35 U.S.C. 154(b) by 410 days.

(21) Appl. No.: 16/061,514

(22) PCT Filed: Nov. 21, 2016

(86) PCT No.: PCT/KR2016/013407
§ 371 (c)(1),
(2) Date: Jun. 12, 2018

(87) PCT Pub. No.: WO2017/111322
PCT Pub. Date: Jun. 29, 2017

(65) Prior Publication Data

US 2020/0263270 A1 Aug. 20, 2020

(30) Foreign Application Priority Data

Dec. 23, 2015 (KR) ..... 10-2015-0184512

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2014/0065007 A1 3/2014 Naitou et al.
2014/0193667 A1 7/2014 Shuto et al.
(Continued)

FOREIGN PATENT DOCUMENTS

CN 103215516 7/2013
CN 103805851 5/2014
(Continued)

OTHER PUBLICATIONS

International Search Report—PCT/KR2016/013407 dated Feb. 13, 2017.
(Continued)

*Primary Examiner* — Anthony M Liang
(74) *Attorney, Agent, or Firm* — Cantor Colburn LLP

(57) ABSTRACT

Provided is an ultra high strength hot-rolled steel sheet including, in percentage by weight: 0.15-0.25% of C, 0.6-2.0% of Si, 1.5-3.0% of Mn, 0.01-0.1% of Al, 0.01-0.5% of Cr, 0.005-0.2% of Mo, 0.001-0.05% of P, 0.001-0.05% of S, 0.001-0.01% of N, 0.003-0.1% of Nb, 0.003-0.1% of Ti, 0.003-0.1% of V, and the remainder being Fe and other unavoidable impurities, and satisfying following relational expressions (1) and (2). [Relational Expression 1] $4.5 \leq [Mn]+12[sol.C]+2.5[Mo]+2[Cr]+300[B]+[V] \leq 5.3$. [Relational Expression 2] $[sol.C]=[C]-(0.25[Ti]+0.13[Nb]+0.125[Mo]), 0.17 \leq [sol.C] \leq 0.22$. (In relational expressions 1 and 2, each element symbol represents the content of each element in wt %).

7 Claims, 1 Drawing Sheet

(51) Int. Cl.

| | |
|---|---|
| ***C21D 6/00*** | (2006.01) |
| ***C22C 38/38*** | (2006.01) |
| ***C22C 38/28*** | (2006.01) |
| ***C22C 38/26*** | (2006.01) |
| ***C22C 38/24*** | (2006.01) |
| ***C22C 38/32*** | (2006.01) |
| ***C22C 38/22*** | (2006.01) |
| ***C22C 38/06*** | (2006.01) |
| ***C22C 38/02*** | (2006.01) |
| ***C22C 38/00*** | (2006.01) |

(52) U.S. Cl.

CPC ..... *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/005* (2013.01)

(56) References Cited

U.S. PATENT DOCUMENTS

| | | | |
|---|---|---|---|
| 2014/0314616 | A1 | 10/2014 | Miyata et al. |
| 2016/0017449 | A1 | 1/2016 | Wang et al. |

FOREIGN PATENT DOCUMENTS

| | | | |
|---|---|---|---|
| CN | 103805869 | | 5/2014 |
| CN | 103946409 | | 7/2014 |
| CN | 104726768 | | 6/2015 |
| EP | 2719788 | | 4/2014 |
| EP | 2824209 | | 1/2015 |
| JP | 2004068095 | | 3/2004 |
| JP | 2005298956 | | 10/2005 |
| JP | 2006183141 | | 7/2006 |
| JP | 2006183141 | A * | 7/2006 |
| JP | 2008038247 | | 2/2008 |
| JP | 2008069425 | | 3/2008 |
| JP | 2015113500 | | 6/2015 |
| KR | 20140027451 | | 3/2014 |
| KR | 20140027526 | | 3/2014 |
| KR | 20140080932 | | 7/2014 |
| KR | 20140084932 | | 7/2014 |
| WO | 2013004910 | | 1/2013 |

OTHER PUBLICATIONS

Speer, et al., Partitioning of carbon from supersaturated plates offerrite, with application to steel processing and fundamentals of the bainite transformation, Current Opinion in Solid State & Materials Science, 2004, pp. 219-237.

Thomas, et al., Considerations in the Application of the "Quenching and Partitioning" Concept to Hot Rolled AHSS Production, AIST Transactions, 2008, pp. 209-217.

European Search Report—European Application No. 16879189.5, dated Oct. 25, 2018, citing JP 2015 113500, EP 2 719 788, EP 2 824 209, JP 2008 038247, WO 2013/004910 and JP 2006 183141.

Chinese Office Action—Chinese Application No. 201680075938.7 dated Sep. 19, 2015, citing JP 2005-298956, CN103946409, CN104726768, KR20140027451, JP 2015-113500, JP 2008-69425, JP 2004-68095 and JP 2006-183141.

* cited by examiner

ULTRA HIGH STRENGTH HOT-ROLLED STEEL SHEET HAVING EXCELLENT DUCTILITY AND METHOD FOR MANUFACTURING SAME

TECHNICAL FIELD

The present inventive concept relates to an ultra high strength hot-rolled steel sheet having excellent ductility and method for manufacturing the same.

BACKGROUND ART

Ultra high strength steels are used in impact absorption members, bumpers, and reinforcing members for automobiles, and have a tensile strength of 1 GPa or more. Such steels may contain an appropriate amount of a retained austenite phase, thereby being easily molded to become parts and having superior impact resistance characteristics due to high strength thereof, even after molding.

Recently, various methods of fabricating ultra high strength steels have been suggested. In particular, in order to obtain a tensile strength of 1 GPa or more and simultaneously secure an elongation of 10% or more, a hot-rolled quenching and partitioning (Q&P) steel utilizing a transformation induced plasticity (TRIP) phenomenon caused by the retained austenite phase has been developed. The Q&P steel may be fabricated by heating a steel to a temperature at which an austenite single phase or an austenite-ferrite dual phase exists to perform a heat treatment for homogenization for a certain period of time, quenching the heated steel to a temperature between a martensite transformation start temperature (Ms) and a martensite transformation end temperature (Mf) thereby forming a martensite phase and a retained austenite phase, and maintaining the quenched steel at a cooling end temperature or heating the quenched steel to a temperature slightly higher than Ms to perform a heat-treatment thereby stabilizing the retained austenite phase.

Such a concept of fabricating the Q&P steel has been suggested by a professor J. G. Speer (Colorado School of Mines, US), et al., as disclosed in Non-Patent Document 1 and Non-Patent Document 2 below. However, there is a problem in that the method in which the process of reheating the steel to a temperature at which the austenite-ferrite dual phase or the austenite single phase exists is added to an ordinary hot-rolling process may require high manufacturing costs.

In order to solve the problem, a method of obtaining the Q&P steel by use of Cr, Ti, Al, and the like, during a cooling process after the ordinary hot-rolling process, has been suggested as disclosed in Patent Documents 1 to 3. However, when Cr and Al are additionally used, the weldability of the steel may deteriorate and material differences between an edge portion and a center portion in a steel sheet may become severe due to an abnormal increase in hardenability of the steel. In addition, when Ti is additionally used, it is difficult to obtain sufficient ductility and bending properties since a fraction of the retained austenite phase decreases due to formation of carbide at a high temperature.

REFERENCES CITED (Patent Document 1) Chinese Patent Application No. 2012-10461655

(Patent Document 2) Chinese Patent Application No. 2012-10461022

(Patent Document 3) Chinese Patent Application No. 2013-10121568

(Non-Patent Document 1) J. G. Speer, D. V. Edmonds, F. C. Rizzo, D. K. Matlock: Curr. Opin. Solid State Mater. Sci. 8 (2004) 219-237.

(Non-Patent Document 2) G. A. Thomas, J. G. Speer, and D. K. Matlock: AIST Trans., 2008, vol. 5 (5), pp. 209-217.

DISCLOSURE

Technical Problem

An aspect of the present inventive concept may provide an ultra high strength hot-rolled steel sheet having excellent ductility by precisely controlling alloy compositions, and a manufacturing method thereof, without significantly changing existing processes of fabricating a hot-rolled steel sheet, and a method of manufacturing the same.

However, aspects of the present inventive concept are not limited to those set forth herein. The above and other aspects of the present inventive concept will become more apparent to one of ordinary skill in the art to which the present inventive concept pertains by referencing the detailed description of the present inventive concept.

Technical Solution

According to an aspect of the present inventive concept, a ultra high strength hot-rolled steel sheet having excellent ductility includes 0.15% to 0.25% carbon (C), 0.6% to 2.0% silicon (Si), 1.5% to 3.0% manganese (Mn), 0.01% to 0.1% aluminum (Al), 0.01% to 0.5% chromium (Cr), 0.005% to 0.2% molybdenum (Mo), 0.001% to 0.05% phosphorus (P), 0.001% to 0.05% sulfur (S), 0.001% to 0.01% nitrogen (N), 0.003% to 0.1% niobium (Nb), 0.003% to 0.1% titanium (Ti), 0.003% to 0.1% vanadium (V), 0.0005% to 0.005% boron (B), a balance of iron (Fe) and unavoidable impurities, by weight percentage, and satisfies following relational expressions 1 and 2.

According to another aspect of the present inventive concept, a method of fabricating a ultra high strength hot-rolled steel sheet having excellent ductility includes heating a slab which includes 0.15% to 0.25% carbon (C), 0.6% to 2.0% silicon (Si), 1.5% to 3.0% manganese (Mn), 0.01% to 0.1% aluminum (Al), 0.01% to 0.5% chromium (Cr), 0.005% to 0.2% molybdenum (Mo), 0.001% to 0.05% phosphorus (P), 0.001% to 0.05% sulfur (S), 0.001% to 0.01% nitrogen (N), 0.003% to 0.1% niobium (Nb), 0.003% to 0.1% titanium (Ti), 0.003% to 0.1% vanadium (V), 0.0005% to 0.005% boron (B), a balance of iron (Fe) and unavoidable impurities, by weight percentage, at a temperature in a range between 1200° C. and 1350° C. and satisfies following relational expressions 1 and 2, forming a hot-rolled steel sheet by hot rolling the heated slab at a temperature in a range between 850° C. and 1150° C., cooling the hot-rolled steel sheet to a cooling end temperature in a range between 200° C. and 400° C. at an average cooling rate of 50 to 100° C./s and coiling the cooled hot-rolled steel sheet, and loading the coiled hot-rolled steel sheet into a heating furnace to be heat-insulated or heated to a temperature in a range between 200° C. to 400° C. so as to satisfy the following relational expression 3.

$$4.5 \le [Mn]+12[sol.C]+2.5[Mo]+2[Cr]+300[B]+[V] \le 5.3 \quad \text{[Relational Expression 1]}$$

$$[sol.C]=[C]-(0.25[Ti]+0.13[Nb]+0.125[Mo]),\ 0.17 \le [sol.C] \le 0.22 \quad \text{[Relational Expression 2]}$$

$$T=\mathrm{Temp}(25[sol.C]+\mathrm{Log}(\mathrm{Time})),\ 2000 \le T \le 2500 \quad \text{[Relational Expression 3]}$$

(Here, each element symbol represents a content (% by weight) of the element in Relational Expression land Relational Expression 2, and Temp and Time respectively represent a temperature (° C.) and time (minutes) of the heating furnace after coiling in Relational Expression 3.)

In addition, the above-described technical solution does not list all the features of the present inventive concept. Various features, advantages, and effects of the present inventive concept can be understood in more detail with reference to following example embodiments.

Advantageous Effects

A ultra high strength hot-rolled steel sheet having excellent ductility according to the present inventive concept can be usefully applied to impact absorption members, bumpers, and reinforcing members for automobiles, and a method of fabricating the same.

MODES FOR CARRYING OUT THE INVENTION

Figure 1:
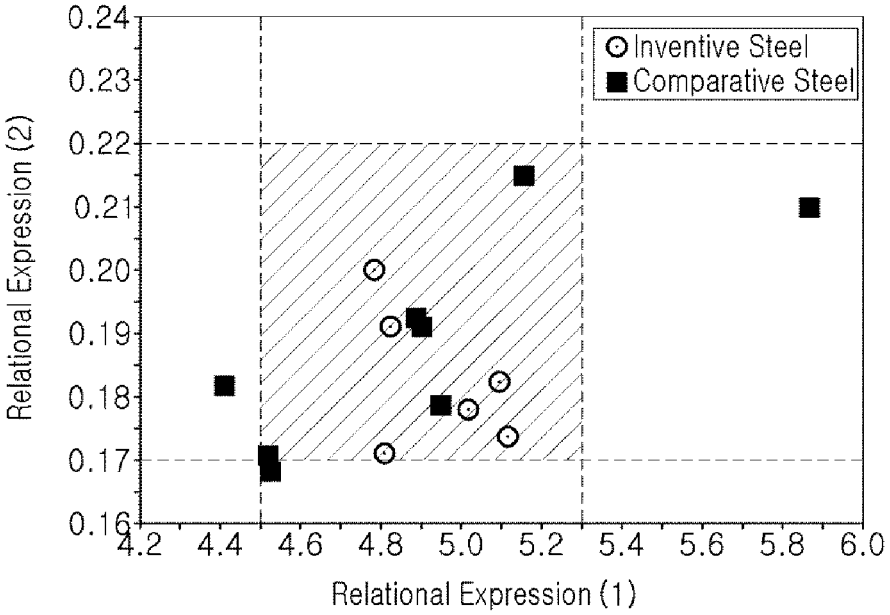
FIG. 1 is a graph illustrating values of Relational Expressions 1 and 2 according to inventive steels and comparative steels.

Hereinafter, example embodiments of the present inventive concept will be described with reference to the accompanying drawings. The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Inventors of the present inventive concept have deeply studied to solve the above-described problems, resulting in providing an ultra high strength hot-rolled steel sheet having excellent ductility by precisely controlling alloy compositions, and a manufacturing method thereof, without significantly changing existing processes of fabricating a hot-rolled steel sheet, and a method of manufacturing the same.

Hereinafter, an ultra high strength hot-rolled steel sheet having excellent ductility according to an example embodiment of the present invention will be described in detail.

The ultra high strength hot-rolled steel sheet having excellent ductility according to the example embodiment of the present invention may include 0.15% to 0.25% carbon (C), 0.6% to 2.0% silicon (Si), 1.5% to 3.0% manganese (Mn), 0.01% to 0.1% aluminum (Al), 0.01% to 0.5% chromium (Cr), 0.005% to 0.2% molybdenum (Mo), 0.001% to 0.05% phosphorus (P), 0.001% to 0.05% sulfur (S), 0.001% to 0.01% nitrogen (N), 0.003% to 0.1% niobium (Nb), 0.003% to 0.1% titanium (Ti), 0.003% to 0.1% vanadium (V), 0.0005% to 0.005% boron (B), a balance of iron (Fe) and unavoidable impurities, by weight percentage, and satisfy the following relational expressions 1 and 2.

$$4.5 \le [Mn]+12[sol.C]+2.5[Mo]+2[Cr]+300[B]+[V] \le 5.3 \quad \text{[Relational Expression 1]}$$

$$[sol.C]=[C]-(0.25[Ti]+0.13[Nb]+0.125[Mo]),0.17 \le [sol.C] \le 0.22 \quad \text{[Relational Expression 2]}$$

(Here, each element symbol represents a content (% by weight) of the element in Relational Expression land Relational Expression 2.)

First, alloy compositions of the ultra high strength hot-rolled steel sheet having excellent ductility according to the example embodiment of the present invention will be described in detail. Hereinafter, a unit of each alloy element is % by weight.

C: 0.15 to 0.25%

Carbon (C) is the most economical and effective element for increasing the hardenability of a steel to strengthen the steel and easily secure the stability of a retained austenite phase. As the content of C increases, a martensite phase and a bainite phase may increase and thereby a tensile strength of the steel may increase.

When the content of C is lower than 0.15%, the retained austenite phase may become unstable. On the other hand, when the content of C exceeds 0.25%, there may be problems in that the hot-rolled steel sheet may have poor weldability, material differences by position in the hot-rolled steel sheet may increase, since microstructural variations increase with a cooling rate, and ductility and shearing workability may be decreased. Accordingly, the content of C may preferably be in the range of 0.15% to 0.25%.

Si: 0.6% to 2.0%

Silicon (Si) functions to deoxidize molten steel, has a solid solution strengthening effect, and is advantageous for forming a retained austenite phase by retarding the formation of coarse carbides.

When the content of Si is lower than 0.6%, it is difficult to stabilize the retained austenite phase since the effect of retarding the formation of coarse carbides is insignificant. On the other hand, when the content of Si exceeds 2.0%, the hot-rolled steel sheet may have poor weldability. Accordingly, the content of Si may preferably be in the range of 0.6% to 2.0%.

Mn: 1.5% to 3.0%

Manganese (Mn), as well as silicon (Si), is an effective element for strengthening a solid solution of steel, and enhances hardenability of a steel to facilitate formation of a martensite phase.

When the content of Mn is lower than 1.5%, the above-described effects may not be obtained. On the other hand, when the content of Mn exceeds 3.0%, the hardenability of the steel may excessively increase and thereby it may become difficult to obtain a preferred microstructure of the hot-rolled steel sheet. In addition, segregation may be greatly developed in a mid-thickness region during a slab-molding operation in a continuous casting process, and the quality of the slab may deteriorate. Further, the microstructure may become nonuniform in a thickness direction during cooling after hot rolling, and the hot-rolled steel sheet may have poor weldability. Accordingly, the content of Mn may preferably be in the range of 1.5% to 3.0%.

Cr: 0.01% to 0.5%

Chromium (Cr) may strengthen solid solution of steel and increase hardenability of the steel, resulting in strengthening of the steel. However, when the content of Cr is lower than 0.01%, the above-described effects may not be obtained. On the other hand, when the content of Cr exceeds 0.5%, segregation may be greatly developed at a mid-thickness region and the microstructures may become nonuniform in the thickness direction, similarly to the case of Mn. Therefore, formability and weldability may deteriorate. Accordingly, the content of Cr may preferably be restricted within the range of 0.01% to 0.5%.

Mo: 0.005% to 0.2%

Molybdenum (Mo) may strengthen a solid solution of steel and increase hardenability of the steel, thereby strengthening the steel. In addition, when Mo is added together with niobium (Nb), titanium (Ti), or the like, it may also contribute to formation of carbide thereby stabilizing solid solution carbon. However, when the content of Mo is lower than 0.005%, the above-described effects may not be obtained. On the other hand, when the content of Mo exceeds 0.2%, quenching properties may abnormally increase and thereby the martensite phase may be easily formed while the stable retained austenite phase is barely formed. In addition, economic efficiency may be lowered and weldability may also deteriorate. Accordingly, the content of Mo may preferably be in the range of 0.005% to 0.2%.

P: 0.001% to 0.05%

Phosphorus (P), similar to Si, may have a solid solution strengthening effect and a ferrite-transformation promoting effect simultaneously. However, excessive manufacturing costs may be required to maintain the content of P at a level lower than 0.001%, which is disadvantageous in economical aspects. In addition, a content of P lower than 0.001% is insufficient to obtain high strength. On the other hand, when the content of P exceeds 0.05%, embrittlement may increase due to segregation in grain boundaries to generate microcracks during a shearing process and greatly degrade ductility and impact resistance characteristics. Accordingly, the content of P may preferably be restricted within the range of 0.001% to 0.05%.

S: 0.001% to 0.01%

Sulfur (S) exists in steel as an impurity. When the content of S exceeds 0.01%, it may form nonmetallic inclusions by combining with Mn or the like. As a result, microcracks may occur during a shearing process of steel, and elongation flange formability and impact resistance may significantly deteriorate. In addition, since it takes a large amount of time to maintain the content of S at a level lower than 0.001% in a steel manufacturing process, productivity may decrease. Accordingly, the content of S may preferably be in the range of 0.001% to 0.01%.

Sol.Al: 0.01% to 0.1%

Soluble aluminum (Sol. Al) may be a component added mainly for deoxidation of the steel. When the content of Sol.Al is lower than 0.01%, the effect of addition of Sol.Al may be negligible. On the other hand, when the content of Sol.Al exceeds 0.1%, it may combine with N to form AlN, which generates corner cracks in the slab during a continuous casting process and defects due to formation of inclusions at edge portions of the hot-rolled steel sheet. Accordingly, the content of Sol.Al may preferably be in the range of 0.01% to 0.1%.

N: 0.001% to 0.01%

Nitrogen (N), as well as C, is a representative solid solution strengthening element, and forms coarse precipitates together with Ti, Al, and the like. Normally, the solid solution strengthening effect of N may be superior to that of C, but there is a problem in that toughness greatly decreases as the content of N in steel increases. In addition, since it takes a large amount of time to maintain the content of N at a level lower than 0.001% in a steel manufacturing process, productivity may decrease. Accordingly, the content of N may preferably be in the range of 0.001% to 0.01%.

Ti: 0.003% to 0.1%

Titanium (Ti), as well as niobium (Nb) and vanadium (V), is a representative precipitation strengthening element, and has strong affinity with N to form coarse TiN in the steel. TiN may have an effect of suppressing grain growth during a heating process for the hot rolling of the steel. In addition, Ti remaining after reacting with N may combine with solid solution C in the steel to form TiC precipitates, which may improve the strength of the steel.

However, when the content of Ti is lower than 0.003%, the above-described effects may not be obtained. On the other hand, when the content of Ti exceeds 0.10%, coarse TiN may be formed to generate microcracks during the shearing process and decrease the solid solution carbon in the steel thereby reducing the stability of the retained austenite phase. Accordingly, the content of Ti may preferably be in the range of 0.003% to 0.1%.

Nb: 0.003% to 0.1%

Niobium (Nb), as well as Ti and vanadium (V), is a representative precipitation strengthening element, and may be precipitated during hot rolling, which leads to the refinement of grains through retarding recrystallization. Accordingly, Nb is an effective element for enhancing the strength and impact toughness of the steel. However, when the content of Nb is lower than 0.003%, the above-described effects may not be obtained. On the other hand, when the content of Ti exceeds 0.1%, there are problems in that recrystallization during hot rolling may be abnormally retarded resulting in formation of elongated grains, and deformation resistance may increase resulting in difficulties in hot rolling of the steel sheet and degradation in shape quality. In addition, the solid solution carbon may decrease and the stability of the retained austenite phase may also decrease. Accordingly, the content of Nb may preferably be in the range of 0.003% to 0.1%.

V: 0.003% to 0.1%

Vanadium (V), as well as Ti and Nb, is a representative precipitation strengthening element, and mainly forms precipitates after coiling to improve the strength of the steel and also increase hardenability of the steel. However, when the content of V is lower than 0.003%, the above-described effects may not be obtained, and when the content of V exceeds 0.1%, shearing workability may deteriorate due to the formation of coarse complex precipitates and it may be difficult to control microstructures due to an abnormal increase in hardenability. In addition, it may be unfavorable in economical aspects to maintain the content of P at a level higher than 0.1%. Accordingly, the content of V may preferably be in the range of 0.003% to 0.1%.

B: 0.0005% to 0.005%

Boron (B) is a representative grain boundary stabilizing element which retards recrystallization during hot rolling and ferrite transformation during cooling after hot rolling, and thereby increasing hardenability. Even a very small amount of B may markedly increase hardenability. However, when the content of B is lower than 0.0005%, the above-described effects may not be obtained. On the other hand, when the content of B exceeds 0.005%, it may be difficult to hot-roll the steel sheet due to the increase in the deformation resistance during hot rolling. In addition, it may be difficult to control microstructures of the steel due to the abnormal increase in hardenability. Accordingly, the content of B may preferably be in the range of 0.0005% to 0.005%.

Another component according to the example embodiments of the present inventive concept is iron (Fe). However, in an ordinary steel manufacturing process, it is inevitable that unintended impurities may be introduced from raw materials and the surrounding environment. Since such impurities are commonly known to those skilled in the art, the entire contents thereof will not be specifically described in the present specification.

It is necessary that an ultra high strength hot-rolled steel sheet having excellent ductility according to example embodiments of the present invention satisfies the following Relational Expressions 1 and 2 as well as the above-described alloy compositions.

When the following Relational Expression 1 and Relational Expression 2 are satisfied, it is easy to form uniform martensite structures and to stabilize untransformed retained austenite phases.

In the following Relational Expression 1 and Relational Expression 2, each element symbol represents a content (% by weight) of the element.

$$4.5 \leq [Mn]+12[sol.C]+2.5[Mo]+2[Cr]+300[B]+[V]5.3 \quad \text{[Relational Expression 1]}$$

Relational Expression 1 relates to quenching properties and segregation of steel. In particular, each component included in Relational Expression 1 may improve hardenability of the steel thereby facilitating formation of the martensite phase. However, C, Mn, and Cr may be easily segregated in a center portion of a steel sheet to form nonuniform microstructures in a thickness direction and degrade weldability. Accordingly, when a value of Relational Expression 1 is lower than 4.5, the quenching properties of the steel may be degraded, and when the value of Relational Expression 1 exceeds 5.3, microstructures of the steel may become nonuniform, and thereby weldability may be degraded.

$$[sol.C]=[C]-(0.25[Ti]+0.13[Nb]+0.125[Mo]),0.17 \leq [sol.C] \leq 0.22 \quad \text{[Relational Expression 2]}$$

Relational Expression 2 may define components related to formation of precipitates in a steel. Since the formation of precipitates relates to the contents of Ti, Nb, Mo, and C in the steel, confirmation of the content of solid solution carbon ([sol.C]) contributing the stability of the retained austenite phase may be required. When the content of [sol.C] is lower than 0.17, it is difficult to sufficiently stabilize the retained austenite phase. When the content of [sol.C] is higher than 0.25, the formation of a large amount of fine precipitates may contribute to an increase in yield strength and formation of fine grains. However, quenching properties of the steel may increase thereby degrading weldability.

Meanwhile, the hot-rolled steel sheet according to the example embodiment of the present inventive concept may have microstructures consisting of 85% or more the martensite phase, 3% to 15% the retained austenite phase, and other unavoidable phases, by area fraction.

When the content of the martensite phase is lower than 85%, it is difficult to secure sufficient tensile strength. In addition, when the content of the retained austenite phase is lower than 3%, elongation and formability may deteriorate, and when the content of the retained austenite phase exceeds 15%, it is difficult to forma sufficient martensite phase, resulting in degradation of the tensile strength.

Here, the unavoidable phases may include ferrite, bainite, and the like, and the sum of the ferrite and bainite may preferably be lower than 5%. When the sum of the ferrite and bainite is 5% or more, the strength of the hot-rolled steel sheet may decrease.

In addition, the hot-rolled steel sheet according to the example embodiment of the present inventive concept may have a tensile strength of 1200 MPa or greater, and an elongation of 10% or greater.

Meanwhile the hot-rolled steel sheet according to the example embodiment of the present inventive concept may include a galvanized layer formed on a surface thereof.

Hereinafter, a method of fabricating an ultra high strength hot-rolled steel sheet having excellent ductility according to another example embodiment of the present inventive concept will be described in detail. The method of fabricating a ultra high strength hot-rolled steel sheet having excellent ductility according to the example embodiment of the present inventive concept includes heating a slab satisfying the above-described alloy composition conditions and the Relational Expressions 1 and 2 at a temperature in a range between 1200° C. and 1350° C., forming a hot-rolled steel sheet by hot rolling the heated slab at a temperature in a range between 850° C. and 1150° C., cooling the hot-rolled steel sheet to a cooling end temperature in a range between 200° C. and 400° C. at an average cooling rate of 50 to 100° C./sec and coiling the cooled hot-rolled steel sheet, and loading the coiled hot-rolled steel sheet into a heating furnace to be heat-insulated or heated to a temperature in a range between 200° C. to 400° C. so as to satisfy a following relational expression 3.

Slab Heating Process

A slab having the above-described alloy compositions and satisfying Relational Expression 1 and Relational Expression 2 is heated to a temperature between 1200° C. and 1350° C.

When the heating temperature of the slab is lower than 1200° C., since carbides, nitrides, and precipitates consisting of Ti, Nb, V, Mo, and the like may not be sufficiently re-solid-soluted, formation of precipitates may decrease in a subsequent process after hot-rolling, thereby retaining coarse TiN. On the other hand, when the heating temperature of the slab exceeds 1350° C., austenite grains may be abnormally grown thereby lowering the strength of the steel. Accordingly, the heating temperature of the slab may preferably be in the range between 1200° C. and 1350° C.

Here, the slab may be produced in a process in which a continuous casting process and a hot-rolling process are directly combined. Since it is important to maintain the temperature of the steel slab in the range between 1200° C. and 1350° C. in order to maintain a proper hot-rolling temperature, the process in which the continuous casting process and the hot-rolling process are directly combined may preferably be applied.

Hot-Rolling Process

The heated slab is hot-rolled at a temperature between 850° C. and 1150° C. to obtain a hot-rolled steel sheet.

When the hot-rolling process is started at a temperature higher than 1150° C., the temperature of the hot-rolled steel sheet is increased, thereby increasing the grain size of the hot-rolled steel sheet and degrading the surface quality of the hot-rolled steel sheet. In addition, when the hot-rolling process is started at a temperature lower than 850° C., elongated grains may be developed, thereby degrading the shape of the hot-rolled sheet since recrystallization may be abnormally delayed. In addition, quenching properties of the hot-rolled steel sheet may be reduced due to the formation of precipitates during the hot-rolling process, and stability of the retained austenite phase may decrease.

Accordingly, the hot-rolling process may preferably be performed at a temperature in the range between 850° C. and 1150° C.

Cooling and Coiling Process

The hot-rolled steel sheet is cooled to a cooling end temperature in a range between 200° C. to 400° C. at an average cooling rate in a range between 50 to 100° C./sec, and coiled.

When the cooling end temperature is lower than 200° C., the microstructures of the steel may be fully phase-transitioned to the martensite phase, thereby increasing strength of the steel while decreasing ductility of the steel. When the cooling end temperature exceeds 400° C., the bainite phase may be formed thereby decreasing both of the strength and ductility of the steel.

In addition, when the average cooling rate is lower than 50° C./sec, it is difficult to secure a target quality of the steel since the ferrite phase or bainite phase may be formed resulting in nonuniform microstructures. When average cooling rate exceeds 100° C./sec, the microstructures of the steel sheet may be nonuniform in a thickness direction and a width direction, and shape quality may be degraded.

Heat-Insulating or Heating Process

The coiled hot-rolled steel sheet is loaded into a heating furnace, and heat-insulated or heated to a temperature in a range between 200° C. and 400° C. so as to satisfy the following Relational Expression 3. After the heat treatment, such as heat-insulating or heating, the hot-rolled steel sheet may be cooled.

$$T=\text{Temp}(25[\text{sol.C}]+\text{Log}(\text{Time})),\quad 2000\leq T\leq 2500 \qquad \text{[Relational Expression 3]}$$

(Here, Temp and Time in Relational Expression 3 respectively represent a temperature (° C.) and time (minutes) of the heating furnace after the coiling process.)

Immediately after the coiling process is completed by hot rolling and cooling the steel sheet, untransformed phases may remain in the steel. The untransformed phases may form a stable retained austenite phase or be fully transformed into a martensite phase depending on subsequent thermal conditions.

Here, it is preferable to load the coiled hot-rolled steel sheet into the heating furnace in a state in which the temperature of the coiled hot-rolled steel sheet is 200° C. or higher. When the temperature is lower than 200° C. before loading, the untransformed phases in the hot-rolled steel sheet may be partially or fully transformed into the martensite phase. In this case, since the retained austenite phase is not sufficiently formed, ductility and formability of the steel may significantly decrease while the strength of the steel significantly increases.

Accordingly, the heat treatment, such as heat-insulating or heating, may be performed at the temperature satisfying Relational Expression 3 so that the stable retained austenite phase is formed in the steel.

Here, the temperature of the heat treatment may not be higher than 400° C., since the content of the solid solution carbon is high in the untransformed phases due to the sufficient cooling rate of 50° C./sec or higher and the quenching properties of the steel. Accordingly, the stable retained austenite phase may be sufficiently secured only by the heat treatment satisfying Relational Expression 3. However, when the value of Relational Expression 3 is lower than 2000, the effect of the heat treatment may not be sufficient. As a result, the retained austenite phase may not be stabilized, thereby being transformed into the martensite phase. When the value of Relational Expression 3 exceeds 2500, the bainite phase may be formed due to diffusion of the solid solution carbon. Accordingly, the strength and ductility of the steel may decrease at the same time, and it may be economically disadvantageous to perform the heat treatment for an extended period of time.

The hot-rolled steel sheet by the above-described processes may have excellent ductility and strength such that the tensile strength thereof is 1200 MPa or more and the ductility thereof is 10% or more.

Meanwhile, after the heat-insulating or heating process, a process of pickling and oiling the hot-rolled steel sheet may additionally be performed.

In addition, a process of heating the hot-rolled steel sheet to a temperature between 450° C. and 480° C. and hot-dip galvanizing the heated hot-rolled steel sheet may be added after the pickling process.

MODES FOR INVENTION

Hereinafter, example embodiments of the present inventive concept will be described in more detail. The present inventive concept may, however, be exemplified in many different forms and should not be construed as being limited to the specific embodiments set forth herein. The scope of the present invention may be defined by the appended claims, and modifications and variations reasonably made therefrom.

Hot-rolled steel sheets were fabricated by heating slabs having compositions listed in Table 1 below at a temperature of 1250° C. under manufacturing conditions listed in Table 2 below.

In Table 1 below, the unit of each alloy element is weight percentage (wt %). In Table 2 below, FDT and CT represent a final hot-rolling ending temperature and a coiling temperature in a hot-rolling process, respectively, and Temp and Time represent a heat treatment temperature and a heat treatment time in a coil heating furnace, respectively. A cooling rate of the cooling process performed immediately after hot rolling, which is not illustrated in Table 2 below, was controlled to be in a range of 70 to 90° C./sec.

In addition, mechanical properties and microstructures of the fabricated hot-rolled steel sheets are listed in Table 3 below.

In Table 3 below, YS, TS, and T-El represent yield strength, tensile strength, and elongation, respectively. The tensile test was carried out on test pieces prepared according to Japanese Industrial Standard (JIS) #5 in a direction parallel to a rolling direction of a rolled steel sheet. The tensile test was carried out three times, and average values of the results thereof are listed in Table 3 below.

In addition, in Table 3 below, area fractions of bainite, martensite, ferrite, and retained austenite were measured at test pieces respectively obtained from center portions of rolled steel sheets. Each test piece was prepared and etched, and then observed using an optical microscope and a scanning electron microscope (SEM) and analyzed using an image analyzer. The area fraction of the retained austenite phase was obtained by analyzing the center portion of each rolled steel sheet using an electron back scattering diffraction (EBSD) method.

TABLE 1

| Division | C | Si | Mn | Cr | Al | P | S | N | Mo | Ti | Nb | V | B |
|---|---|---|---|---|---|---|---|---|---|---|---|---|---|
| C. Steel 1 | 0.22 | 1.01 | 1.62 | 0.7 | 0.03 | 0.012 | 0.003 | 0.005 | 0.01 | 0.02 | 0.03 | 0.004 | 0.001 |
| C. Steel 2 | 0.19 | 0.8 | 1.7 | 0.1 | 0.03 | 0.011 | 0.003 | 0.005 | 0.01 | 0.02 | 0.015 | 0.004 | 0.001 |
| C. Steel 3 | 0.19 | 0.62 | 1.55 | 0.2 | 0.035 | 0.015 | 0.003 | 0.004 | 0.1 | 0.03 | 0.015 | 0.005 | 0.001 |
| C. Steel 4 | 0.21 | 0.65 | 1.8 | 0.15 | 0.03 | 0.01 | 0.006 | 0.005 | 0.07 | 0.025 | 0.02 | 0.001 | 0.001 |

TABLE 1-continued

| Division | C | Si | Mn | Cr | Al | P | S | N | Mo | Ti | Nb | V | B |
|---|---|---|---|---|---|---|---|---|---|---|---|---|---|
| C. Steel 5 | 0.23 | 0.7 | 1.6 | 0.4 | 0.03 | 0.01 | 0.004 | 0.004 | 0.01 | 0.04 | 0.03 | 0.001 | 0.0005 |
| C. Steel 6 | 0.18 | 0.8 | 1.82 | 0.1 | 0.035 | 0.01 | 0.003 | 0.005 | 0.06 | 0.005 | 0.005 | 0.001 | 0.001 |
| C. Steel 7 | 0.21 | 0.6 | 1.88 | 0.1 | 0.027 | 0.009 | 0.003 | 0.004 | 0.01 | 0.05 | 0.04 | 0.05 | 0.0015 |
| C. Steel 8 | 0.2 | 0.7 | 1.65 | 0.15 | 0.03 | 0.01 | 0.003 | 0.004 | 0.1 | 0.02 | 0.03 | 0.003 | 0.002 |
| I. Steel 1 | 0.2 | 0.8 | 1.6 | 0.3 | 0.025 | 0.006 | 0.002 | 0.004 | 0.01 | 0.02 | 0.02 | 0.005 | 0.001 |
| I. Steel 2 | 0.21 | 1.1 | 1.8 | 0.2 | 0.027 | 0.007 | 0.003 | 0.003 | 0.01 | 0.025 | 0.02 | 0.01 | 0.0005 |
| I. Steel 3 | 0.19 | 1 | 1.7 | 0.25 | 0.025 | 0.006 | 0.003 | 0.005 | 0.1 | 0.015 | 0.02 | 0.005 | 0.001 |
| I. Steel 4 | 0.2 | 1.45 | 1.7 | 0.4 | 0.025 | 0.01 | 0.003 | 0.004 | 0.1 | 0.01 | 0.02 | 0.005 | 0.0005 |
| I. Steel 5 | 0.18 | 1.5 | 1.8 | 0.45 | 0.028 | 0.006 | 0.003 | 0.003 | 0.01 | 0.015 | 0.01 | 0.006 | 0.001 |
| I. Steel 6 | 0.19 | 1 | 2 | 0.35 | 0.032 | 0.006 | 0.002 | 0.004 | 0.01 | 0.03 | 0.025 | 0.005 | 0.0005 |

* C. Steel: Comparative Steel, I. Steel: Inventive Steel

TABLE 2

| Specimen | Relational Ex. (1) | Relational Ex. (2) | Relational Ex. (3) | FDT (° C.) | CT (° C.) | Loading Temp.(° C.) | Temp (° C.) | Time (min.) |
|---|---|---|---|---|---|---|---|---|
| C. Steel 1 | 5.87 | 0.210 | 2308.0 | 883 | 379 | 203 | 300 | 280 |
| C. Steel 2 | 4.41 | 0.182 | 2077.6 | 889 | 319 | 211 | 300 | 240 |
| C. Steel 3 | 4.52 | 0.168 | 2093.8 | 897 | 296 | 216 | 300 | 600 |
| C. Steel 4 | 4.88 | 0.192 | 2174.0 | 901 | 228 | 165 | 280 | 900 |
| C. Steel 5 | 5.15 | 0.215 | 2913.9 | 892 | 383 | 220 | 350 | 900 |
| C. Steel 6 | 4.52 | 0.171 | 1630.1 | 909 | 382 | 250 | 250 | 180 |
| C. Steel 7 | 4.90 | 0.191 | 2266.3 | 900 | 430 | 300 | 300 | 600 |
| C. Steel 8 | 4.95 | 0.179 | 1735.5 | 914 | 120 | 85 | 250 | 300 |
| I. Steel 1 | 4.82 | 0.191 | 2115.9 | 910 | 265 | 226 | 280 | 600 |
| I. Steel 2 | 4.78 | 0.200 | 2242.4 | 917 | 383 | 313 | 300 | 300 |
| I. Steel 3 | 4.81 | 0.171 | 2026.8 | 903 | 307 | 257 | 300 | 300 |
| I. Steel 4 | 5.09 | 0.182 | 2201.4 | 898 | 328 | 274 | 300 | 600 |
| I. Steel 5 | 5.12 | 0.174 | 2112.4 | 912 | 379 | 315 | 300 | 500 |
| I. Steel 6 | 5.02 | 0.178 | 2168.4 | 892 | 349 | 249 | 300 | 600 |

* Relational Ex.: Relational Expression

TABLE 3

| Specimen | YS (MPa) | TS (MPa) | T-El (%) | Bainite (%) | Martensite (%) | Ferrite (%) | Retained Austenite (%) |
|---|---|---|---|---|---|---|---|
| C. Steel 1 | 1255 | 1427 | 7.3 | 2 | 95 | 0 | 3 |
| C. Steel 2 | 765 | 986 | 16.5 | 26 | 72 | 1 | 1 |
| C. Steel 3 | 1021 | 1159 | 10.4 | 15 | 83 | 0 | 2 |
| C. Steel 4 | 1143 | 1406 | 7.8 | 2 | 98 | 0 | 0 |
| C. Steel 5 | 895 | 1055 | 14.0 | 9 | 89 | 0 | 2 |
| C. Steel 6 | 1010 | 1344 | 8.2 | 5 | 94 | 0 | 1 |
| C. Steel 7 | 654 | 889 | 18.3 | 75 | 20 | 3 | 2 |
| C. Steel 8 | 1180 | 1405 | 7.6 | 2 | 98 | 0 | 0 |
| I. Steel 1 | 1062 | 1209 | 12.1 | 0 | 92 | 0 | 8 |
| I. Steel 2 | 1108 | 1298 | 11.5 | 1 | 89 | 0 | 10 |
| I. Steel 3 | 1070 | 1244 | 11.2 | 1 | 94 | 0 | 5 |
| I. Steel 4 | 1195 | 1388 | 10.9 | 0 | 93 | 0 | 7 |
| I. Steel 5 | 1176 | 1354 | 10.4 | 1 | 93 | 0 | 6 |
| I. Steel 6 | 1189 | 1376 | 10.8 | 0 | 94 | 0 | 6 |

It is found that Inventive Steels 1 to 6 satisfying all of the alloy compositions, Relational Expressions 1 to 3, and manufacturing conditions had tensile strengths of 1200 MPa or more and elongations of 10% or more.

In the other hand, Comparative Steel 1 had a high value of Relational Expression 1 and did not satisfy the content of Cr. Accordingly, most of the microstructures of Comparative Steel 1 were formed as the martensite phase due to excessively high hardenability thereof. Comparative Steel 1 had low elongation while having high strength.

Comparative Steel 2 had a low value of Relational Expression 1, and thereby had low hardenability. Accordingly, Comparative Steel 2 did not have sufficient martensite and retained austenite phases since bainite phase transition occurred during the cooling process.

Comparative Steel 3 satisfied Relational Expression 1 and has sufficient hardenability. However, since it did not satisfy Relational Expression 2, the bainite phase increased while the stable retained austenite phase decreased. Accordingly, Comparative Steel 3 had a low strength.

Although Comparative Steel 4 satisfied all of Relational Expressions 1 to 3, it was loaded into the heating furnace and heated in a state the steel coiled after the hot-rolling and cooling were completed was cooled to a temperature lower than 200° C., the temperature suggested according to the present inventive concept. Accordingly, most of untransformed phases were transformed into the martensite phase, thereby having a low elongation while having a high strength.

Comparative Steel 5 had an abnormally high value of Relational Expression 3 and it was heated in the heating furnace at an excessively high temperature for an extended period of time after the cooling process. Accordingly, Comparative Steel 5 had a large amount of bainite phase while having a small amount of retained austenite phase. This was because portions of the retained austenite phase were not stabilized but transformed into the bainite phase. Therefore, Comparative Steel 5 did not have a sufficiently high strength.

Comparative Steel 6 had a low value of Relational Expression 3, and the retained austenite phase was not sufficiently stabilized but transformed into the bainite phase since temperature and time of the heat treatment were insufficient. Accordingly, Comparative Steel 6 had low ductility.

Comparative Steel 7 and Comparative Steel 8 did not satisfy the coiling temperature conditions. Comparative Steel fabricated at a temperature higher than the coiling temperature suggested according to the present inventive concept had a microstructure mostly formed as the bainite phase and thereby had inferior strength. In addition, Comparative Steel 8 fabricated at a temperature lower than the coiling temperature suggested according to the present inventive concept had a microstructure mostly formed as the martensite phase and thereby had inferior elongation.

Figure 2:
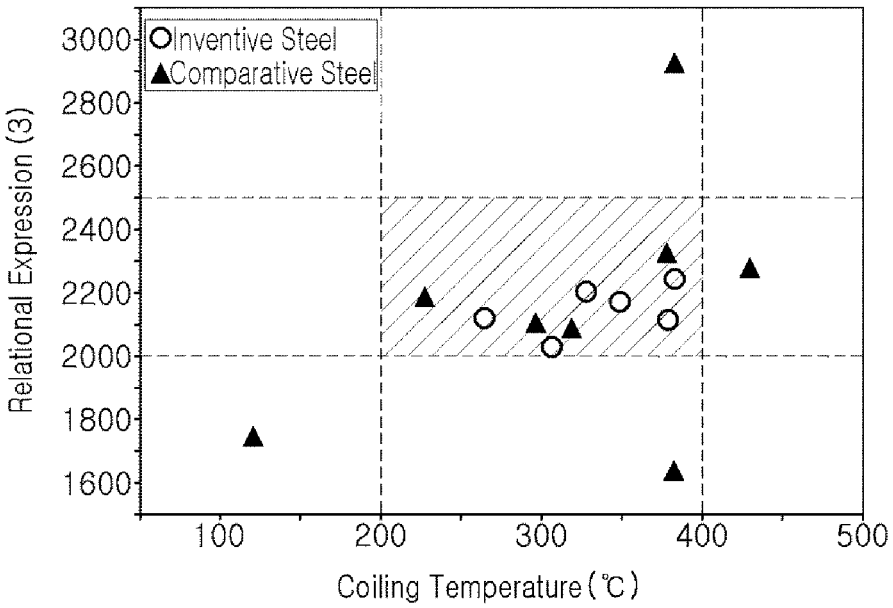
FIG. 2 is a graph illustrating coiling temperatures and values of Relational Expression 3 according to inventive steels and comparative steels.

FIG. 1 is a graph illustrating values of Relational Expressions 1 and 2 in Inventive Steels and Comparative Steels, and FIG. 2 is a graph illustrating coiling temperatures and values of Relational Expression 3 in Inventive Steels and Comparative Steels. It can be seen that the present inventive concept is effective when Relational Expression 3, as well as Relational Expressions 1 and 2 related to the alloy compositions, are satisfied.

The invention claimed is:

1. An ultra high strength hot-rolled steel sheet having excellent ductility, comprising:

0.15% to 0.25% carbon (C), 0.6% to 2.0% silicon (Si), 1.5% to 3.0% manganese (Mn), 0.01% to 0.1-'soluble aluminum (sol. Al), 0.01% to 0.5% chromium (Cr), 0.005% to 0.2% molybdenum (Mo), 0.001% to 0.05% phosphorus (P), 0.001% to 0.05% sulfur (S), 0.001% to 0.01% nitrogen (N), 0.003% to 0.1% niobium (Nb), 0.003% to 0.1% titanium (Ti), 0.003% to 0.01% vanadium (V), 0.0005% to 0.005% boron (B), and a balance of iron (Fe) and unavoidable impurities, by weight percentage, and satisfying the following Relational Expressions 1 and 2:

$$4.5 \le [Mn]+12[sol.C]+2.5[Mo]+2[Cr]+300[B]+[V] \le 5.3 \quad \text{[Relational Expression 1]}$$

$$[sol.C]=[C]-(0.25[Ti]+0.13[Nb]+0.125[Mo]),0.17 \le [sol.C] \le 0.22, \quad \text{[Relational Expression 2]}$$

where each element symbol represents a content, by weight percentage, of each element; and a microstructure including 85% or more martensite, 3% to 15% retained austenite, and unavoidable phases, by area fraction, wherein the hot-rolled steel sheet has a tensile strength of 1200 MPa or greater, and an elongation rate of 10% or greater.

2. The ultra high strength hot-rolled steel sheet of claim 1, wherein the unavoidable phases includes ferrite and bainite, and a sum of the ferrite and the bainite is lower than 5% by area fraction.

3. The ultra high strength hot-rolled steel sheet of claim 1, further comprising: a galvanized layer formed on a surface thereof.

4. A method of fabricating the ultra high strength hot-rolled steel sheet having excellent ductility according to claim 1, comprising:

heating a slab at a temperature in a range between 1200° C. and 1350° C., wherein the slab includes 0.15% to 0.25% carbon (C), 0.6% to 2.0% silicon (Si), 1.5% to 3.0% manganese (Mn), 0.01% to 0.1% soluble aluminum (sol. Al), 0.01% to 0.5% chromium (Cr), 0.005% to 0.2% molybdenum (Mo), 0.001% to 0.05% phosphorus (P), 0.001% to 0.05% sulfur (S), 0.001% to 0.01% nitrogen (N), 0.003% to 0.1% niobium (Nb), 0.003% to 0.1% titanium (Ti), 0.003% to 0.01% vanadium (V), 0.0005% to 0.005% boron (B), a balance of iron (Fe) and unavoidable impurities, by weight percentage, and satisfies the following Relational Expressions 1 and 2;

forming a hot-rolled steel sheet by hot rolling the heated slab at a temperature in a range between 850° C. and 1150° C.;

cooling the hot-rolled steel sheet to a cooling end temperature in a range between 200° C. and 400° C. at an average cooling rate of 50° C./s to 100° C./s and coiling the cooled hot-rolled steel sheet; and loading the coiled hot-rolled steel sheet into a heating furnace to be heat-insulated or heated to a temperature in a range between 200° C. and 400° C. so as to satisfy the following Relational Expression 3, $$4.5 \le [Mn]+12[sol.C]+2.5[Mo]+2[Cr]+300[B]+[V] \le 5.3 \quad \text{[Relational Expression 1]}$$

$$[sol.C]=[C]-(0.25[Ti]+0.13[Nb]+0.125[Mo]),0.17 \le [sol.C] \le 0.22, \quad \text{[Relational Expression 2]}$$

$$T=\text{Temp}(25[sol.C]+\text{Log}(\text{Time})),\ 2000 \le T \le 2500, \quad \text{[Relational Expression 3]}$$

wherein each element symbol represents a content, by weight percentage, of each element in Relational Expression 1 and Relational Expression 2, and the Temp and the Time respectively represent a temperature, in ° C., and time, in minutes, of the heating furnace after coiling in Relational Expression 3.

5. The method of claim 4, further comprising pickling and oiling the hot-rolled steel sheet after heat-insulating or heating.

6. The method of claim 4, further comprising heating the hot-rolled steel sheet until a temperature of the hot-rolled steel is in a range between 450° C. and 480° C. and hot-dip galvanizing the heated hot-rolled steel sheet, after pickling.

7. The method of claim 4, wherein the slab is fabricated in a process in which a continuous casting process and a hot-rolling process are directly combined.

* * * * *